US007584552B2

(12) United States Patent
Krauss

(10) Patent No.: US 7,584,552 B2
(45) Date of Patent: Sep. 8, 2009

(54) HEEL STABILIZER

(75) Inventor: Betsy M. Krauss, Stamford, CT (US)

(73) Assignee: Weather Or Not, LLC, Stamford, CT (US)

( * ) Notice: Subject to any disclaimer, the term of this patent is extended or adjusted under 35 U.S.C. 154(b) by 601 days.

(21) Appl. No.: 10/982,923

(22) Filed: Nov. 8, 2004

(65) Prior Publication Data

US 2006/0096126 A1 May 11, 2006

(51) Int. Cl.
*A43B 3/16* (2006.01)

(52) U.S. Cl. ..... 36/7.1 R; 36/72 R; 36/7.3; 36/50.1

(58) Field of Classification Search ..... 36/7.1 R, 36/7.3, 72 R, 50.1
See application file for complete search history.

(56) References Cited

U.S. PATENT DOCUMENTS

| | | | | |
|---|---|---|---|---|
| 1,075,930 | A | | 10/1913 | Murray |
| 1,187,778 | A | | 6/1916 | Paskett |
| 2,068,238 | A | | 1/1937 | Malm |
| 2,319,239 | A | | 5/1943 | Laird |
| 3,283,422 | A | | 11/1966 | Nygard |
| 3,737,723 | A | | 6/1973 | Kanor |
| 4,083,124 | A | | 4/1978 | Michalak |
| 4,335,527 | A | | 6/1982 | Pask |
| 4,369,588 | A | | 1/1983 | Berguer |
| 4,489,510 | A | | 12/1984 | Williams |
| 4,516,336 | A | | 5/1985 | Nissenbaum |
| 4,598,485 | A | | 7/1986 | Joe et al. |
| 4,693,018 | A | | 9/1987 | Maleyko et al. |
| 4,785,556 | A | | 11/1988 | Blair |
| 4,896,438 | A | * | 1/1990 | DeBease ..... 36/7.1 R |
| 5,056,240 | A | | 10/1991 | Sherrill |
| 5,226,245 | A | | 7/1993 | Lamont |
| 5,553,399 | A | | 9/1996 | Strong |
| 5,787,607 | A | * | 8/1998 | Schurch ..... 36/7.1 R |
| 5,822,884 | A | | 10/1998 | Roeder |
| 5,950,333 | A | * | 9/1999 | Tsen ..... 36/7.1 R |
| 5,974,591 | A | * | 11/1999 | Leslie ..... 2/323 |
| 5,983,526 | A | | 11/1999 | Pawlik et al. |
| 5,996,258 | A | | 12/1999 | Simmons |
| 6,209,227 | B1 | | 4/2001 | Swango et al. |
| 6,339,888 | B1 | | 1/2002 | Brunson et al. |
| 2003/0088997 | A1 | | 5/2003 | Mihailovich |
| 2003/0154630 | A1 | | 8/2003 | Lewis et al. |

FOREIGN PATENT DOCUMENTS

| | | |
|---|---|---|
| DE | 3 606 837 | 9/1987 |
| EP | 0 507 302 | 10/1992 |

* cited by examiner

*Primary Examiner*—Jila M Mohandesi
(74) *Attorney, Agent, or Firm*—Gianna Julian-Arnold; Miles & Stockbridge P.C.

(57) ABSTRACT

The present invention relates to heel stabilizing technology. In one embodiment, when incorporated in footwear or a footwear cover, the heel stabilizing technology includes an adjustable heel tension fastener that is used in conjunction with an upper stabilizing means. Once adjusted, the heel tension fastener provides an upwards tension vertical to the upper stabilizing means.

17 Claims, 4 Drawing Sheets

HEEL STABILIZER

FIELD OF THE INVENTION

The present invention relates to heel stabilizing technology that can be used alone, incorporated within shoes, or incorporated within shoe covers for shoes with flat to any height heels.

BACKGROUND OF THE INVENTION

Women's rain gear has come into its own. Gone are the days when a raincoat, umbrella and rain boots are nothing more than a utilitarian way to keep dry.

The contemporary equivalent of the British-inspired Wellington boot hit the U.S. market in Fall 2000. These "pattern wellies" or printed novelty rain boots were sellouts with their floral print designs. Now, other designers and boot manufacturers have followed suit by creating tall and short rain boots, as well as ankle height Chelsea style rain boots and rubber clogs featuring stripes, polka dots, plaids and more.

These fashion-forward rain boots have created a new niche in the women's rain gear category. Previously, the only choices for women's protective footwear for rainy weather have been black or green knee high Wellingtons; black rubber galoshes; low casual rubber boots (i.e. Muck or duck boots); gardening boots or clogs; jogging overshoes; and the clear plastic/rubber hybrid overshoes for high heel shoes with heels no higher than 1½".

However, when women dress in business attire or evening wear, accessorized with high heel shoes averaging well in excess of 1½", the need for protective footwear for rain which provides both aesthetic satisfaction and physical functionality has yet to be adequately addressed.

What is currently needed by women who have a closet full of shoes with heels of all different heights, is a fashionable protective shoe cover that will not only look good, but will offer the unique benefit of helping reduce the teetering from side-to-side inherent when they wear high heel shoes, particularly when wearing the shoes inside a shoe cover in inclement weather conditions.

U.S. Pat. No. 1,075,930 (the '930 patent) shows a shoe cover that can accommodate shoes with heels of unspecified height, having a fairly rigid and slip-resistant sole. However, the shoe cover of the '930 patent has a multitude of cumbersome fasteners, does not have a means for fastening the shoe cover to the wearer's ankle or calf, and does not prevent or minimize teetering in high heel shoes.

U.S. Pat. No. 2,068,238 (the '238 patent) shows a shoe cover that is waterproof, but that does not have the capability of protecting a shoe with a high heel.

U.S. Pat. No. 3,283,422 (the '422 patent) shows a disposable shoe cover, but it does not have a sufficiently rigid, anti-slip sole, or fasteners to secure the wearer's shoe into the shoe cover. The '422 patent shows a shoe cover that can accommodate shoes with heels of unspecified height. However, the shoe cover of the '422 patent does not have a slip-resistant or sufficiently rigid sole, is devoid of any type of fastener, and does not minimize teetering in high heel shoes.

U.S. Pat. No. 4,335,527 (the '527 patent) shows a shoe cover that is disposable, can accommodate shoes with heels of unspecified height, and has a slip-resistant sole. However, the shoe cover of the '527 patent has a fastener only at the ankle of the boot which would not secure a high heel shoe inside the boot, the sole is not rigid, and the shoe cover does not have a means of minimizing teetering in high heel shoes.

U.S. Pat. No. 4,516,336 (the '336 patent) shows a protective shoe cover that is waterproof or water-resistant and collapsible for ease of carrying in a purse. A plurality of elastic bands are positioned along different portions of the shoe cover to properly position the shoe cover on the wearer's leg and over the wearer's shoe or boot. The heel member (28) and the sole member (30) constitute reinforcing members to provide a durable walking surface. However, it would be very difficult to insert a high heel shoe into the opening of the shoe cover of the '336 patent and down the body of the boot. Although the shoe cover of the '336 patent can accommodate shoes with heels of unspecified height, has a slip-resistant sole and ankle fastener, the sole is not sufficiently rigid, and it does not have a means of minimizing teetering in high heel shoes. Further, the boot of the '336 patent is not disposable, the elastic band that gathers the boot material onto the arch of the boot could be hazardous if bulky gatherings get caught on an uneven slippery surface. Additionally, the separate heel and sole portions do not provide the same amount of security as would a heel and sole constructed in the same piece. Lastly, a tall, narrow heel such as a spike heel would not be strong enough to hold down the heel portion of the boot and can cause a tripping hazard.

U.S. Pat. No. 4,598,485 (the '485 patent) shows a slip resistant, disposable shoe cover with a body formed of a flexible, foldable, sheet material, the shoe cover comprising a bottom rib formed of a strip of flexible, stretchable, resilient and slip-resistant material.

U.S. Pat. No. 4,693,018 (the '018 patent) and German Patent No. DE 3,606,837 (the '837 patent) show a shoe cover that has the advantage of being extendible in bootleg coverage, but it is not disposable or compact for carrying in a purse.

U.S. Pat. No. 4,785,556 (the '556 patent) and published U.S. Pat. No. 0,088,997 (the '997 patent) show shoe covers that can accommodate heeled shoes of varying height, but these shoe covers are not disposable in nature and do not cover the ankle of the wearer. Furthermore, the soles of these shoe covers, although they have tread patterns, do not provide for increased ground contact effectively making the wearer walk on snow and ice in high heels with treads. The shoe covers of the '556 patent and the '997 patent have extendible heels, are devoid of any type of fastener, and do not minimize teetering in high heel shoes.

U.S. Pat. No. 5,056,240 (the '240 patent) shows a shoe cover for receiving a shoe or boot that has mud or dirt thereon so as to permit a person entering a house or other clean environment to enter without depositing mud therein. Although the shoe cover of the '240 patent provides a sufficiently rigid sole, it is for indoor use, does not have a slip-resistant sole, does not accommodate high heel shoes, and does not have a means of creating tension at the heel to provide the wearer of high heel shoes with greater stability. The '240 patent has gripping action on the interior surface of the sole of the shoe cover, however, it does not provide for securing the shoe cover around a front section of the shoe and on the leg so that the wearer's shoe is not positively engaged by any portion of the shoe cover.

U.S. Pat. No. 5,226,245 (the '245 patent) shows a protective boot structure having an innersole including a plate (37) of relatively rigid material such as cardboard.

U.S. Pat. No. 5,996,258 (the '258 patent) shows a flexible shoe cover that shields shoes from scratches and abrasions. The shoe cover of the '258 patent has an upper member that extends over a front top portion of a shoe, a lower member extending below a front sole portion of the shoe and extending toward the heel of the shoe, and an intermediate flexible portion connected between the upper member and the lower member. Although the shoe cover of the '258 patent can accommodate high heel shoes and has a slip-resistant sole, its sole is not sufficiently rigid. Further, the shoe cover does not have a fastener at the opening of the leg shaft and does not have a means of providing tension at the heel.

There is a need for a device that would decrease the side-to-side teetering inherent when wearing high heel shoes, thereby increasing the balance and therefore stabilization of the wearer's high heel shoe, foot and ankle thereby lessening the possibility of tripping. In particular, the present invention relates to heel stabilization technology consisting of a tension and counter tension at and/or near the heel of the wearer's footwear. As will be seen in this patent application, this tension and counter tension can be provided in a variety of embodiments.

SUMMARY OF THE INVENTION

The present invention solves these problems by utilizing a heel tension fastener and an upper stabilizing means. This heel stabilizing technology can be used alone, (in conjunction with a wearer's own shoes or shoe covers), incorporated within shoes, or incorporated within shoe covers. The heel stabilizing technology comprises a heel tension fastener and an upper stabilizing means. The heel tension fastener is attached to the back and/or side(s) of the heel area on a shoe or shoe cover. The heel tension fastener can be adjusted by the wearer depending on the specific height of the wearer's shoe heel. In one embodiment the heel tension fastener comprises one or more fasteners such as buckle(s), tab(s), snap(s), button(s), toggle closure(s), tie(s), hook and eye, hook and loop, elastic, drawstring, and/or any other type or combination of fastener, located and/or placed on the back and/or side(s) of the shoe, or shoe cover in the heel area. The upper stabilizing means comprises an adjustable strap that encircles the wearer leg at any point, including but not limited to below the knee, at the ankle, and/or at the calf. Preferably the upper stabilizing means comprises any means of fastening at some point or points on the mid to upper heel and below the knee to ensure a snug fit and an adjustment means such as hook and loop, elastic, buckles, tabs, or other mechanism which grips, and/or wraps and/or is secured closed. When the heel tension fastener is appropriately adjusted a tension is created between the upper stabilizing means and the heel tension fastener, that results in slightly pulling the heel of the shoe cover and inner shoe upward thereby aiding in the stabilization of the wearer's shoe in the case of a shoe cover, and slightly pulling the heel of the shoe itself upward, in the case of the heel stabilization technology being applied directly to a shoe. The present invention offers the increased balance benefit provided by the tension of the heel fastener to help stabilize heels of any height.

The shoe cover, which can optionally be disposable, is constructed of non-porous, flexible material, with a preferably slip-resistant, sufficiently rigid sole so that it will not buckle when used with a high heel shoe that has less ground coverage by virtue of the inherently higher instep. Optionally, the shoe cover of the present invention can have a leg shaft portion that has the capability of being rolled up or down, or is otherwise adjustable, to convert from ankle height to below the knee height. The present invention further provides a shoe cover that can be economical enough to be discarded after use; stable enough for wearers of high heel shoes in rain, slush, ice, snow and/or any other unsafe, or unsanitary conditions; sufficiently compact and light in weight to carry conveniently; waterproof or water-resistant; and wherein the pattern of the shoe cover can be altered, permitting adaptability to a multiplicity of sizes and shapes, and for a variety of fashion properties. The present invention can alternatively be useful where temporary and inexpensive surgical protection is desired such as over casts, bandages or the like.

It is an object of the present invention to provide a heel tension fastener that is comprised of one or more fastening mechanisms, and that when used in conjunction with an upper stabilizing means reduces side-to-side teetering of high heels and enhances stabilization.

It is a further object of the present invention to provide an anchoring mechanism that is comprised of one or more fastening mechanisms, wherein the anchoring mechanism can either be attached to the shoe or shoe cover, or incorporated within the shoe or shoe cover, and where the anchoring mechanism is incorporated within the shoe or shoe cover, the anchoring mechanism incorporates one or more materials as part of the material composition and/or design of the shoe itself.

It is a further object of the present invention to provide a heel tension fastener that is either located and/or attached to, one or more locations on any combination of the back and/or at least one side of the shoe or shoe cover.

It is a further object of the present invention to provide a heel tension fastener that is either located, and/or attached, above the heel area of the shoe or shoe cover, such that the heel tension fastener pulls the heel of the shoe or shoe cover slightly upward resulting in a tension between it and the anchoring fastener and/or anchoring material.

It is a further object of the present invention to provide a heel tension fastener that is incorporated within the shoe or shoe cover that is manufactured with a shortened heel consisting of rubber and/or plastic and/or other elastic material.

It is a further object of the present invention to provide a heel tension fastener that is incorporated within footwear, wherein the heel of the footwear is not rubber and/or plastic and/or other elastic material, and wherein the heel tension fastener itself has some elasticity which will be stretched downward when the wearer walks thereby resulting in a tension and counter tension between itself and the anchoring fastener and/or anchoring material.

It is a further object of the present invention to provide a heel tension fastener that is incorporated within the shoe or shoe cover, wherein the heel of the footwear is not rubber and/or plastic and/or other elastic material, and wherein the heel tension fastener itself has some elasticity and can create a tension and counter tension within its own components thereby eliminating the need for an anchoring fastener and/or anchoring material.

It is a further object of the present invention to provide a heel tension fastener that is incorporated within the shoe or shoe cover, wherein an area or areas above the heel and/or side or sides of the footwear itself is made of rubber and/or plastic and/or other elastic material so that when the heel tension fastener is engaged, it pulls up on that area, resulting in the heel of the footwear pulling slightly upwards creating a tension and counter tension when the anchoring fastener and/or anchoring material is adjusted to fit the wearer snugly.

It is a further object of the present invention is to provide a shoe cover that can be packaged in a compact size, and when released from it's packaging, unfolds so that the wearer's shoe can be inserted into one end of the leg shaft and consequently into the main body portion of the disposable shoe cover easily. Preferably, the wearer's entire shoe will be covered by the shoe cover, including any ankle strap the shoe may have.

It is a further object of the present invention to provide a sole that is sufficiently rigid so that it will not buckle when used with a high heel shoe that inherently has less ground coverage. Preferably, the sole will have a ribbed or roughened walking surface that can be tread-like or formed having various geometric patterns or configurations. More preferably, the sole of the shoe cover can be made rigid in and of itself relative to the balance of the shoe cover such as by making the sole thicker or by some other suitable means. Alternatively, a separate piece of material such as, but not limited to rubber, plastic, coated cardboard or the like can be inserted into the sole of the shoe cover to provide increased rigidity.

DETAILED DESCRIPTION OF THE PREFERRED EMBODIMENTS

Figure 1:
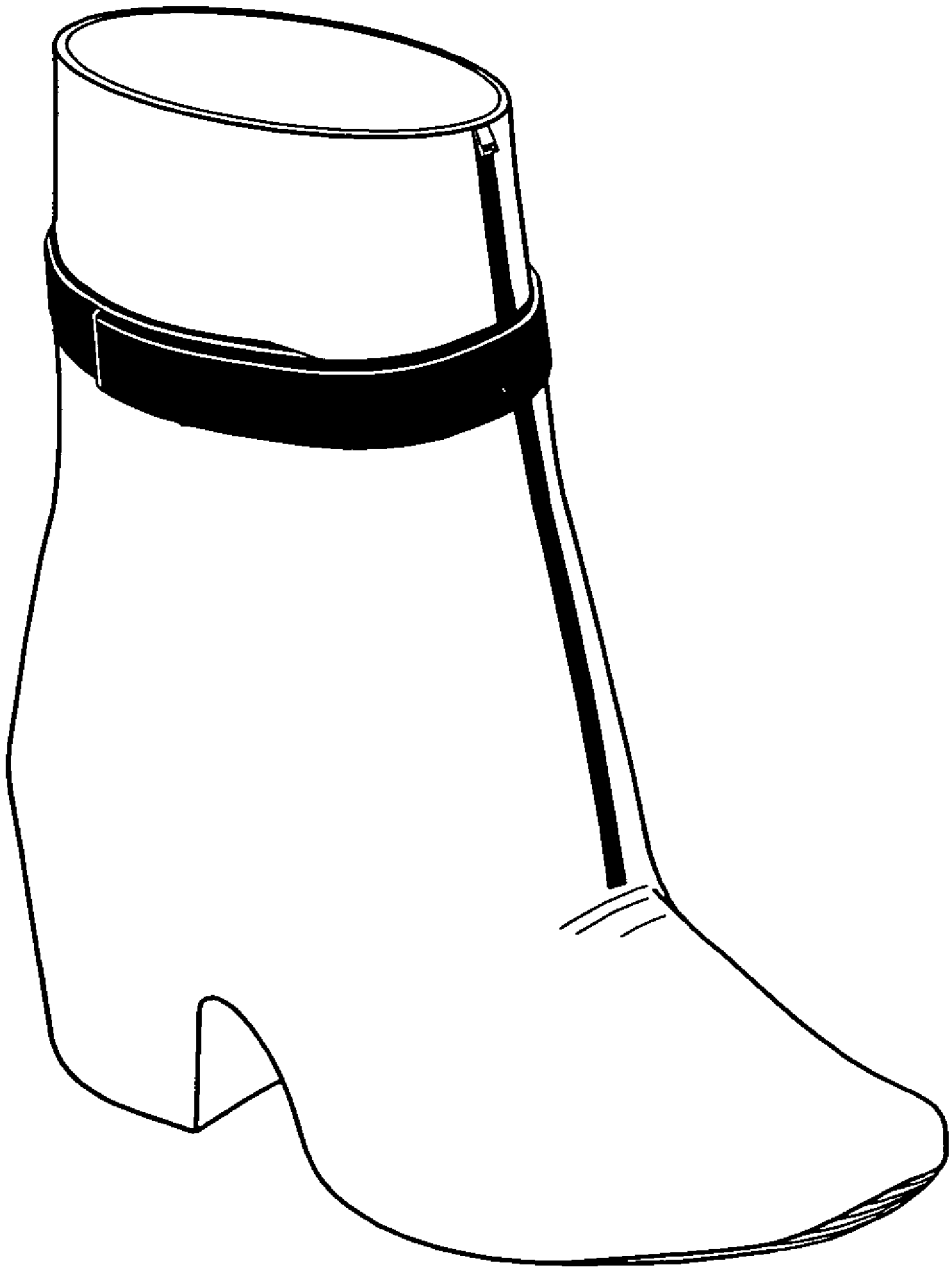
FIG. 1 is a side oblique view of the shoe cover of the present invention
Figure 2:
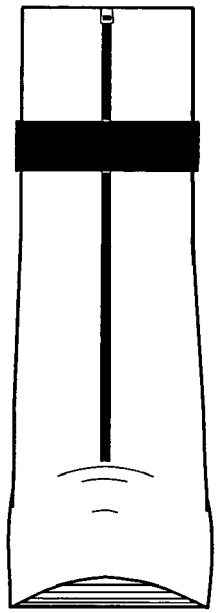
FIG. 2 is a rear view of the shoe cover of the present invention, illustrating adjusted heel tension fastener.
Figure 3:
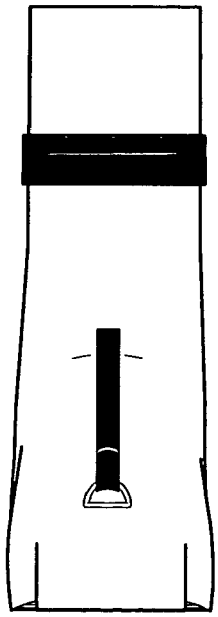
FIG. 3 is a rear view of the shoe cover of the present invention, illustrating non-adjusted heel tension fastener.
Figure 4:
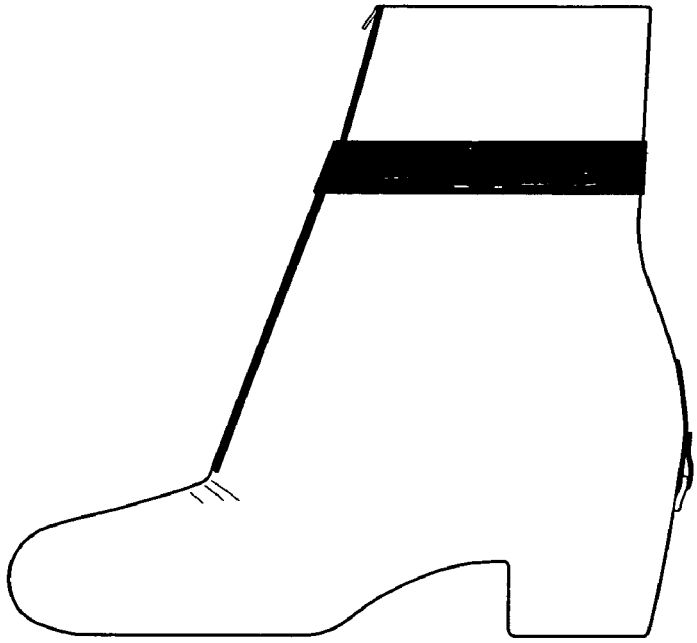
FIG. 4 is a side view of the shoe cover of the present invention.
Figure 5:
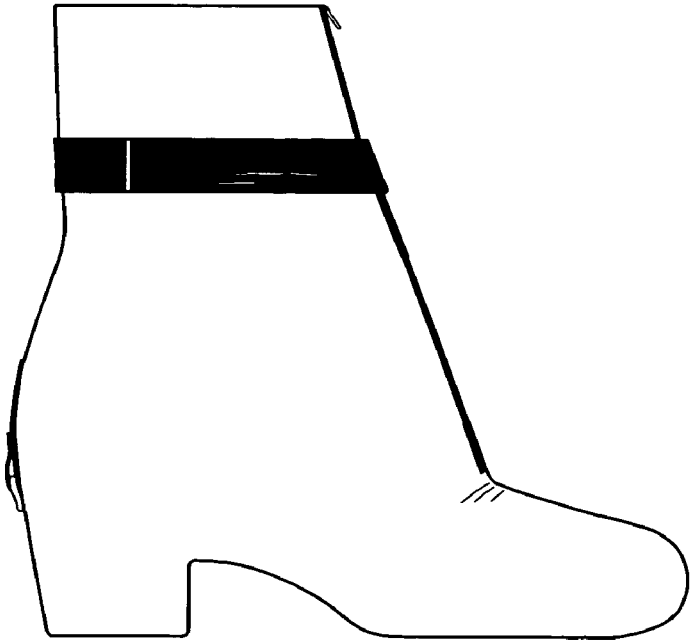
FIG. 5 is a side view of the shoe cover of the present invention
Figure 6:
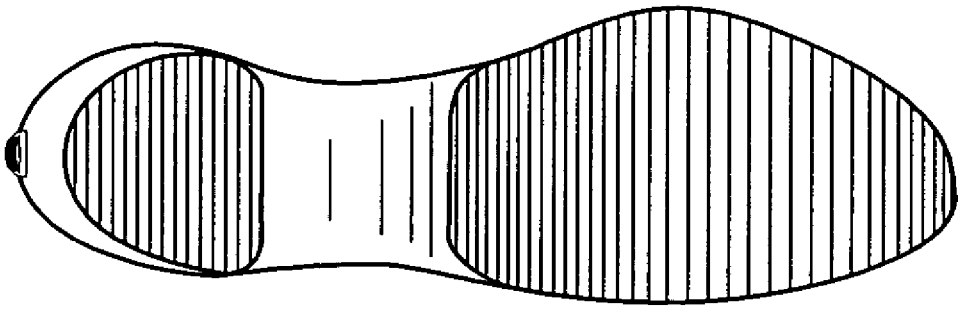
FIG. 6 is a bottom view of the shoe cover of the present invention.
Figure 7:
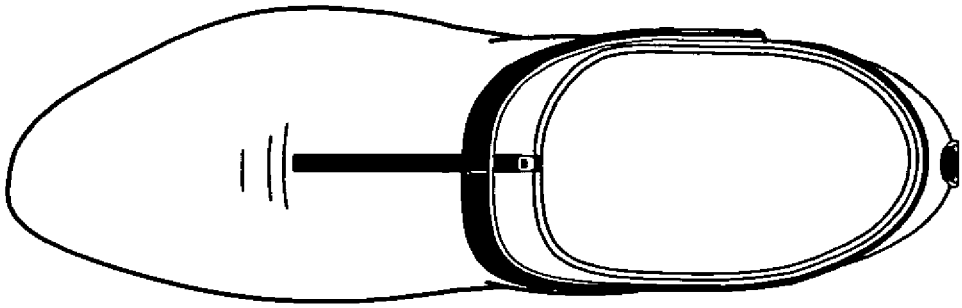
FIG. 7 is a top view of the shoe cover of the present invention.

The heel stabilizing technology of the present invention provides increased stability to wearers of high heel shoes. Further, when incorporated within or attached to a shoe cover, the present invention provides increased stability to wearers of high heel shoes in inclement weather conditions and protects a wearer's shoes from other sources of wear and tear. Throughout this application the term "shoe" or "shoes" shall be held to encompass all footwear, including but not limited to pumps, sandals, boots, and the like. Throughout this application the term fastener shall be held to encompass all buckle (s), tab(s), snap(s), button(s), toggle closure(s), tie(s), hook and eye, hook and loop/self grip, elastic, drawstring, and/or loops in any combination.

In a preferred embodiment, the heel tension fastener is located at and/or attached to the back and/or sides of the heel portion of the shoe or shoe cover, and is adjusted by the wearer by pulling the loose end of the fastener upward until an upward tug at the heel of the shoe and shoe cover is felt. The heel tension fastener is then securely closed. Preferably, the leg shaft has an upper stabilizing means such as an adjustable ankle fastener, preferably at least one ankle strap. In one embodiment, such ankle strap can be passed through a choice of high or low guide loops included with a shoe cover, to thereby select one of several locking positions, depending upon the height of the shoe heel. The adjustable ankle strap on the leg shaft preferably fits snugly around the wearer's ankle and provides a counter tension to the heel tension fastener.

The heel tension fastener can be a buckle, a water-resistant fabric tab with a hook and loop closure with more than one position for locking into place depending upon the height of the heel of the wearer's shoe, or other suitable fastening means. The heel tension fastener provides tension at the critical point of the heel of the wearer's shoe and shoe cover to minimize loss of balance and teetering from side-to-side.

The upper stabilizing means can be wrapped around the ankle of the shoe cover to provide a snug fit for counter tension for the heel tension fastener. The wrapping or fastening can serve the dual purpose of providing counter tension to the heel tension fastener while preventing rain and snow from entering the shoe cover at the ankle or the leg. Similarly in an alternative embodiment, a closing means is provided in addition to the upper stabilizing means.

Alternatively, the upper stabilizing means can be at least one fastener that would adjust the shoe cover material at a point of the wearer's leg, including but not limited to below the knee, at the ankle, or at the calf, to provide for a snug shoe cover fit.

The heel tension fastener of the preferred embodiment makes it possible for wearers of high heel shoes to wear shoe covers in inclement weather because the tension provided by the heel tension fastener helps minimize the amount of side-to-side teetering that is inherent when wearing high heel shoes. The tension of the heel tension fastener in the present invention specifically aids in stabilizing the wearer's foot while in their high heels inside the shoe cover. The shoe cover of the present invention stabilizes the wearer's foot by stabilizing the heel of the wearer's shoe and ankle.

Alternatively, the shoe cover of the present invention can optionally have a leg shaft that is constructed of more rigid material such as heavier weight vinyl, waterproof or water-resistant leather or some other suitable material. The stiffness of the material combined with a secure closure, such as a zipper closure or other suitable closure, will provide the counter tension needed for the heel tension fastener. According to this embodiment, the more rigid material of the leg shaft begins above the heel portion of the shoe cover.

Alternatively, the shoe cover of the present invention can optionally be secured to a section of the front portion of the wearer's shoe replicating the area where a dress shoe is generally secured to the foot of the wearer, by an elastic band or some other means of fastening, as well as around the leg.

Alternatively, the shoe cover can also be constructed so that the material at the heel is slightly pulled upward and is sewn or in some fashion permanently tacked into one position with the counter tension being provided by the rigidity of the leg shaft of the shoe cover, and/or by fasteners on the shoe cover. The slightly raised section on the heel will be secured at a height that would work for shoes with heel heights from flat up to and including 6 inches. In this embodiment, no heel tension fastener is needed because the shoe cover heel is constructed as though it was being pulled up by a heel tension fastener. Although the heel tension fastener offers the wearer a choice of tension adjustments, depending upon the material selected for the main body portion, the sole and the leg shaft of the shoe cover, it may not be necessary for the wearer to have the ability to adjust the tension at the heel, instead relying upon a preset level of adjustment by the manufacturer. According to this embodiment, a comparatively rigid piece of plastic, rubber or other suitable, preferably waterproof or water-resistant material, would be needed which would be placed or manufactured into the inner periphery of the heel cup so that when a narrow high heel shoe is worn, the bottom of the shoe cover does not tip when striking the ground.

Alternatively, the shoe cover has a shortened heel, wherein the amount necessary to have the heel shorter than the sole will depend upon the material, type, thickness, and elasticity, used for the shoe cover. According to this embodiment, the shoe cover is made to create the heel of the shoe cover slightly higher off the ground than the rest of the sole of the shoe cover. As a result, when the wearer's high heel pushes downward toward the ground, a tension will automatically be created and stability will be provided. According to this embodiment, a counter tension at some point above the heel of the shoe cover may still be required, as well as a comparatively rigid piece of plastic, rubber or other suitable material, which would be placed or manufactured into the inner periphery of the heel cup.

Alternatively, the shoe cover of the present invention is disposable and made of a material that is inexpensive, lightweight, yet sturdy enough for at least a one-time use, but can be used multiple times depending on the wearer. The shoe cover of the present invention can be economical and disposable or reusable.

Alternatively, the leg shaft and the main body portion of the disposable shoe cover can be formed from a suitable waterproof or water-resistant flexible material, such as, for example, rubber, plastic, vinyl, nylon, PVC, microfiber, another suitable polymeric or resin, or other suitable material that would be well known to one of ordinary skill in the art.

Alternatively, a heavier version of the shoe cover is made for winter wear and a lighter version is made for rainwear. According to this embodiment, the shoe cover is lined for warmth.

Alternatively, the heel portion of the shoe cover is constructed of vinyl or some other waterproof or water-resistant material and may or may not extend around the entire lower portion of the shoe cover depending upon the material used. According to this embodiment, the entire leg shaft and main body portion of the shoe cover is constructed of a more rigid material such as waterproof leather, or other material, and then only the heel portion of the shoe cover would be vinyl or some other waterproof material that can be pulled upward by the heel tension fastener.

Alternatively, the shoe cover of the present invention can optionally have a drawstring or other closure at the opening of the leg shaft to keep rain, snow and other undesirable elements from entering the shoe cover. Depending upon the type fastener used, the opening of the leg shaft can require a water-resistant fabric hem that will accommodate the gathering nature of a closure such as a drawstring.

In a preferred embodiment, the shoe cover has at least one wraparound strap or short tab that goes across a zipper pull. This strap or tab enables the wearer to tighten the top of the shoe cover so that it fits snugly against the calf to keep the rain, snow and other elements out.

Alternatively, the leg shaft can optionally have the ability to roll up or down the leg to provide a shoe cover with an ankle height or below the knee height.

Alternatively, the closure of the leg shaft can optionally have one or more zippers which can optionally have plastic teeth, and can optionally have a waterproof or water-resistant piece of material backing the inside of the zipper to prevent possible water seepage through the teeth of the zipper. The zipper of the shoe cover can be positioned on the leg shaft only, and/or can also extend onto the main body portion of the shoe cover. According to a preferred embodiment, the zipper extends down onto a part of the main body portion of the shoe cover such as to create a wider opening of the leg shaft that optionally eliminates the need for a drawstring closure at the top since there will not be much gapping around the leg of the wearer.

Alternatively, the shoe cover comprises a gusset which could be secured closed by fasteners that would enable the wearer to insert their shoe into the front of the shoe cover with ease.

Alternatively, the main body portion of the shoe cover of the present invention comprises a tongue that is preferably waterproof and more preferably stretchy, which prevents moisture and dirt from entering the shoe cover. The tongue can be comprised of vinyl, nylon, Spandex®, microfiber or some other suitable material. A tongue with sufficient stretch will facilitate insertion of a high heel shoe into the leg shaft opening of the shoe cover, and would be secured into place by fasteners.

Alternatively, instead of having a tongue which would help form the wide opening of the shoe cover (so as to accommodate the higher arch created by a high heeled shoe), the sides of the upper portion of the leg shaft can extend further forward toward the toe of the shoe cover. The sides would then be secured close by one or more zippers or other suitable closing means, and there would be some kind of fastener at the opening of the leg shaft such as, a locking drawstring, strap or other suitable fastening means that would prevent rain and snow from entering the shoe cover at the opening.

Alternatively, the shoe cover has closures on the gusset, one or more fastenings on a point of the leg shaft of the shoe cover corresponding to a point on the wearer's leg, including but not limited to below the knee, at the ankle, or at the calf to create an "anchor" or counter tension. According to this embodiment, the gusset could be replaced by one or more zippers, preferably, covered zippers, hook and loop or other suitable closing means.

Preferably, a top strap (or multiple smaller ones) which can be thicker and adjustable, encircles the entire ankle and/or calf and/or below the knee to serve as the counter tension to the heel tension fastener or to the shortened heel or to the tacked or sewn up heel. The strap will close with a buckle(s), tab(s), snap(s), button(s), toggle closure(s), tie(s), hook and eye, hook and loop, elastic, drawstring, or other suitable closure and the end of the strap will have hook and loop, a keeper or other means to attach it closely to the shoe cover. The strap is secured to the shoe cover and wraps around the ankle and/or calf and/or below the knee and then passes through the fastener. Then the end of the strap, which can have hook and loop on it, will either adhere to the shoe cover between the buckle and the beginning of the strap or be tucked into a keeper.

Alternatively, the sole has an inside and an outside surface with a heel portion and a toe portion. The sole is preferably slip-resistant, rigid in and of itself relative to the leg shaft and main body portion of the shoe cover. The sole is slip-resistant by means of grits, ridges, cleats or some other method of providing slip-resistance.

Alternatively, the sole of the present invention is reinforced by inserting a plastic, rubber, coated cardboard or other suitable, preferably waterproof or water-resistant, material into the bottom of the shoe cover to provide greater rigidity. The shoe cover is to be worn over a shoe with a heel height from flat to any height, wherein the rigidity of the sole or bottom of the shoe cover provides greater stability to the wearer.

Alternatively, the sole and heel is thicker than the rest of the shoe cover so that a stiletto heel will not puncture the shoe cover heel. However, a heel cup or heel strike consisting of a puncture proof material which would be inserted by the manufacturer directly into the heel of the shoe cover can also be used. According to this embodiment, the bottom of the heel can be manufactured with a puncture proof material, which may or may not be rigid.

According to another preferred embodiment, the shoe cover of the present invention can optionally have ridges or some kind of slip resistant feature on the interior surface of the sole of the shoe cover to provide increased stability to the heel of the wearer's shoe while inside the shoe cover.

Alternatively, the shoe cover of the present invention is for consumer use, but can also be used for industrial purposes, are primarily for outdoor use, but can also be used indoors, and are used by the wearer whenever it is desirable to keep shoes safe, clean and or dry from inclement weather or other adverse conditions.

In addition to providing the wearer with shoe protection, the shoe cover of the present invention can also be fashionable in that it can be composed of transparent, translucent, semi-transparent, and/or opaque material and can be tinted or colored in any variety of colors or colorless. The shoe covers of the present invention can also include designs such as glitter, stripes, flowers, animal prints and the like, can be embossed with a variety of patterns, and can include fashionable attachments or decorations such as charms, rhinestones, dimensional paint dots, and the like. The shoe cover of the present invention preferably adds to instead of detracting from the fashionable appearance of the wearer.

Alternatively, the heel of the shoe cover is lined with a dense foam or the like, which can be antibacterial, that surrounds the heel of the wearer's shoe thereby increasing the stability.

Alternatively, a thick foam-like material, or other material that can be antibacterial is attached to the inner ankle area of the shoe cover, and extending down into the sides of the shoe cover heel. The foam provides stability to the wearer's ankle and high heel by encasing and providing a snug fit. This embodiment can optionally have a shortened heel.

Alternatively, the entire shoe cover can be lined. The heel cushioning can be used in conjunction with the heel tension fastener or could be used alone.

Alternatively, the shoe cover heel reaches the ground; and there is at least one upper stabilizing means comprising at least one fastener(s) at a point of the leg shaft of the shoe cover corresponding to a point on the wearer's leg, including but not limited to below the knee, at the ankle, or at the calf. In this embodiment, the material of the shoe cover is more rigid than the heel portion of the shoe cover and is secured closed by, a means of closure, including but not limited to a zipper, and a heel tension fastener strap that is attached to the area at and/or near the heel bulge of the shoe cover and then secured at the top of the shoe cover. According to this embodiment, the strap extends from the area at and/or near the heel bulge of the shoe cover and then secures up to the top of the shoe cover. The wearer is able to tug up at the strap and adjust it to a comfortable point at the top of the shoe cover. The wearer would feel a stabilizing tension down the back of the shoe cover. In addition or instead of the at least one fastener, the upper stabilizing means can be a leg shaft of material that is more rigid relative to the heel bulge area.

Alternatively, the heel is not shortened, and the ankle and heel are very rigid, possibly made of leather or plastic that is reinforced by stays or some other means.

In order to engage the heel tension fastener when the heel is not shortened until the heel tension fastener is engaged, the wearer would first close the opening of the shoe cover where they inserted their shoe by the means provided on the shoe cover. Next, the anchoring fastener and/or anchoring material provides counter tension to the heel tension fastener, securing it closed such that it fits snugly to the wearer. Lastly, the heel tension fastener is engaged by pulling the loose end and securing it closed when a tug/tension is felt by the wearer at the heel of the shoe cover and subsequently the heel of the shoe inside the shoe cover, resulting in a tension that provides increased stability and improved balance when walking in the high heel shoe inside the shoe cover, as compared to walking in a high heel shoe inside a shoe cover without a heel tension fastener. When the heel tension fastener is engaged, the material at the back of the shoe cover heel will buckle slightly and the bottom of the shoe cover heel will be lifted off the ground slightly, but will be forced down to the ground when the wearer walks.

In order to engage the heel tension fastener when using the shortened heel embodiment, whether shortened by using less material or by tacking up, the wearer will need to put their weight on the ball of the foot thus raising their shoe heel and subsequently the heel of the shoe cover off the ground. Next, the wearer would close the opening of the shoe cover where they inserted their shoe by the means provided on the shoe cover. Next, the wearer would engage the anchoring fastener (s) and/or the anchoring material to fit snugly. Next, the heel tension fastener which is located at the back and/or side(s) of the heel portion of the shoe cover would be adjusted by the wearer by pulling the lose end of the fastener until feeling a tug at the heel of the shoe cover, and subsequently the heel of the shoe inside the shoe cover. Lastly, the wearer would lock the heel tension fastener into that position. The resulting tension and counter tension created as the wearer walks will help reduce side-to-side teetering and thereby increase the balance and stability of the wearer lessening the possibility of tripping.

Alternatively, it should be noted that the heel tension fastener of the present invention could be used directly on footwear to stabilize the wearer, even when not wearing a shoe cover. According to this embodiment, the addition of a heel tension fastener could be applied to a high heel shoe, boot or other footwear when there is an upper stabilizing means to provide a counter tension. The upper stabilizing means can be made as part of the footwear during the manufacturing process, such as, but not limited to an ankle strap, or can be attached by the wearer by, but not limited to a hook and loop and/or some other type of fastener.

Optionally, when applying heel stabilizing technology directly to a shoe itself, it may be desirable to add a T-strap, which would extend from the top of the shoe vamp to the ankle strap to lessen any pressure around the ankle which may result from the engaged heel tension fastener.

Optionally, when applying the heel stabilizing technology directly to the shoe itself, it may be desirable to use a stiff leather or some other material that would be sufficiently rigid to the sides of the ankle strap that extend from the footbed up to the encircling ankle strap, to provide more stability to the ankle strap that is functioning as an anchor for counter tension to the heel tension fastener.

It can be appreciated that variations to the present invention would be readily apparent to those skilled in the art, and the present invention is intended to include those alternatives.

While the present invention is clearly designed to address the unique needs of wearers with high heel shoes, that does not preclude men, women and children wearing any type of footwear from taking advantage of the balance enhancing features of the present invention.

Accordingly, the scope of the present invention should be assessed as that of the appended claims and any equivalents thereto.

What is claimed is:

1. A shoe cover comprising:

a leg shaft, wherein the leg shaft is of a length sufficient to cover the wearer's ankle area, and wherein the leg shaft has an opening of a width sufficient to accommodate the shoe instep;

a foot-shaped body, said body comprising an inside surface, an outside surface, a front, a back, at least one side(s), and a bottom;

a tension fastening means; said tension fastening means having an upper portion and a lower portion, wherein said lower portion of said tension fastening means is attached to at least one of the back or the side(s) of said leg shaft, wherein said tension fastening means is parallel to said leg shaft, and wherein said tension fastening means is adjustable; and an upper stabilizing means, wherein said upper stabilizing means circles an upper portion of the leg shaft and wherein said upper stabilizing means is secured by a fastening means, said upper stabilizing means being connected to said upper portion of said tension fastener means;

wherein adjusting said tension fastener means provides an upwards tension within said leg shaft.

2. The shoe cover of claim 1, wherein the opening of the leg shaft is secured by at least one closing means.

3. The shoe cover of claim 2, wherein the at least one closing means is selected from the group of closing means consisting of buckle(s), tab(s), snap(s), button(s), toggle closure(s), tie(s), hook and eye, zipper, hook and loop, elastic, drawstring, and combinations thereof.

4. The shoe cover of claim 1, wherein the fastening means is selected from the group of fastening means consisting of buckle(s), tab(s), snap(s), button(s), toggle closure(s), tie(s), hook and eye, hook and loop, elastic, drawstring, and combinations thereof.

5. The shoe cover of claim 1, wherein said upper stabilizing means is rigid relative to said leg shaft.

6. The shoe cover of claim 1, wherein said tension fastener means is vertical to said upper stabilizing means.

7. The shoe cover of claim 1, wherein the leg shaft length is adjustable.

8. The shoe cover of claim 1, wherein, a material is inserted into the bottom of the shoe cover to increase the provided rigidity.

9. The shoe cover of claim 1, wherein the foot shaped body is constructed of a material selected from the group of materials consisting of rubber, plastic, and combinations thereof.

10. The shoe cover of claim 1, wherein the bottom has a textured surface to provide slip resistance, and wherein the textured surface is created by using a variety of treads.

11. A shoe comprising:

a foot bed, said foot bed having at least one side(s), a front portion, a rear portion, and a bottom;

a heel, wherein said heel is attached to the bottom of the rear portion of said foot bed, and wherein said heel has a front and a back;

at least one tension fastener means, wherein each said tension fastener means is adjustable, each said tension fastener means having an upper portion and a lower portion and wherein each said tension fastener means is attached to at least one of the rear portion of the foot bed, at least one side(s), or the back of the heel; and wherein adjusting said tension fastener means provides an upwards tension within said leg shaft; and an upper stabilizing means, said upper stabilizing means being connected to said upper portion of said tension fastener means; wherein said upper stabilizing means circles the leg of the wearer of the shoe; and wherein said upper stabilizing means is adjustable.

12. The shoe of claim 11, wherein adjusting said tension fastener means provides an upwards tension between said tension fastening means and said upper stabilizing means.

13. The shoe of claim 12, wherein said tension fastener means is vertical to said upper stabilizing means.

14. The shoe of claim 12, wherein said upper stabilizing means is secured by a fastening means, wherein the fastening means is selected from the group of fastening means consisting of buckle(s), tab(s), snap(s), button(s), toggle closure(s), tie(s), hook and eye, hook and loop, elastic, drawstring, and combinations thereof.

15. The shoe of claim 12, wherein said upper stabilizing means comprises a rigid material.

16. The heel stabilizer technology of claim 14, wherein said upper stabilizing means is adjustably attached to a material having elastic properties, wherein said material is attached to a bottom of a shoe heel, and wherein said bottom of said shoe heel comprises said anchoring means, wherein said upper stabilizing means is secured by said fastening means, and wherein said fastening means is selected from the group of fastening means consisting of buckle(s), tab(s), snap (s), button(s), toggle closure(s), tie(s), hook and eye(s), hook and loop(s), drawstring, and combinations thereof.

17. The heel stabilizer technology of claim 14, wherein said upper stabilizing means is adjustably attached to a rigid fixed shaft and wherein said shaft is attached to an anchoring material, said shaft being attached by an attaching means and wherein said attaching means is at least a portion of the tension fastening means.

* * * * *